US005443202A

United States Patent [19]

Jørgensen-Beck et al.

[11] Patent Number: 5,443,202

[45] Date of Patent: Aug. 22, 1995

[54] CARTON BOX OF THE PIVOT LID TYPE HAVING MEANS FOR SNAP LOCKING THE LID

[75] Inventors: Frode Jørgensen-Beck; Heinrich W. Lambach, both of Horsens, Denmark

[73] Assignee: Schur Engineering A/S, Horsens, Denmark

[21] Appl. No.: 178,231

[22] PCT Filed: Jul. 9, 1992

[86] PCT No.: PCT/DK92/00220

§ 371 Date: Jan. 10, 1994

§ 102(e) Date: Jan. 10, 1994

[87] PCT Pub. No.: WO93/01095

PCT Pub. Date: Jan. 21, 1993

[30] Foreign Application Priority Data

Jul. 10, 1991 [DK] Denmark ..... 1333/91

[51] Int. Cl.[6] ..... B65D 5/06

[52] U.S. Cl. ..... 229/146; 229/125.26; 229/160.1

[58] Field of Search ..... 229/149, 160.1, 125.26, 229/125.28, 141, 148, 145, 146

[56] References Cited

U.S. PATENT DOCUMENTS

| | | | |
|---|---|---|---|
| 2,226,477 | 12/1940 | Moore | 229/149 X |
| 3,326,447 | 6/1967 | Williamson | 229/149 X |
| 3,642,193 | 2/1972 | Rada | 229/149 X |
| 3,756,501 | 9/1973 | Skillen et al. | 229/141 X |
| 3,942,712 | 3/1976 | Bundy et al. | 229/149 X |
| 4,948,038 | 8/1990 | Moeller | 229/149 X |
| 4,964,561 | 10/1990 | Whelan | 229/149 X |

*Primary Examiner*—Allan N. Shoap
*Assistant Examiner*—Christopher T. McDonald
*Attorney, Agent, or Firm*—Antonelli, Terry, Stout & Kraus

[57] ABSTRACT

The carton has a hinged top with a depending flange in the front. A panel is folded up against the inside of the depending flange. The middle of the folded up panel has an arcurate nose and the edges are adhered to the depending flange, causing the nose to bulge out slightly from the depending flange. This nose engages a slot on the front panel of the carton to lock the top in place.

7 Claims, 3 Drawing Sheets

CARTON BOX OF THE PIVOT LID TYPE HAVING MEANS FOR SNAP LOCKING THE LID

Figure 1:
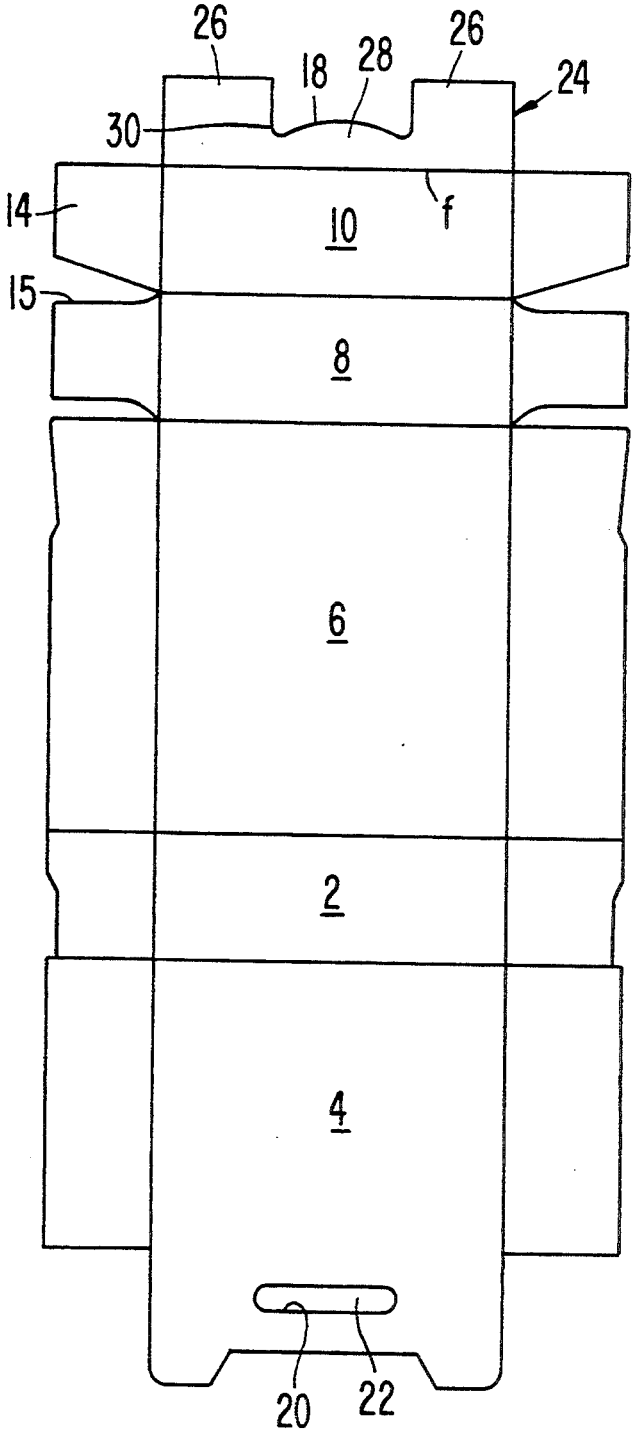

The present invention relates to a carton box of the pivot lid type, typically a pastille box, having an open narrow end covered by a lid member, which is outwardly or upwardly pivotal about a hinge line at the rear side of the box, while at its three other sides it has depending lid skirt portions which, in the closed position of the lid, project inwardly or downwardly over the mouthing area of the box. For simplicity the boxes will here be described as being oriented with their mouthing turned upwardly, while they will of course be usable with other orientations.

With this kind of boxes it is a traditional problem how to make sure that the lid in its closed position is suitably locked to the box, as a free pivotability of the lid is not desirable. For avoiding unintended openings of the box it is required to operate with a sort of snap locking of the closed lid, such that a certain opening force should be exerted on the lid for opening it. Such a snap locking has already been proposed established in different manners, though each with associated drawbacks with respect to either production or use. The boxes are mass production objects, for which it is decisive that the production costs be held very low, while for the practical use it is just as important that the said locking action will appear not only by the first opening of the box or a few openings thereafter, but rather by many following openings and closings.

For the boxes known so far it has been a problem that either they have been too expensive to produce or their integrated locking portions such as projecting carton flaps has become deformed rather soon, that is after only few openings and closings, in a manner such that they loose their snap locking effect after few operations.

It is the purpose of the present invention to provide a box which is easy to produce in a manner such that the integrated snap locking parts will remain effective through the entire operative lifetime of the box, i.e. through many successive openings and closings of the box.

The invention is based on the recognition that a projecting locking nose portion should not necessarily be a projecting, flexible flap of the material, as it may well be a more spatially designed part, which may exhibit a higher stability against being bent at all.

To be more specific, in connection with the invention it has been observed that on a carton portion a slightly projecting portion can be provided by folding back an outer flap area of the material and fixing to the underlying panel only the outer side areas of the folded flap, while the intermediate part of the flap is left unfixed to the said panel. This bent over middle portion of the flap will thus be free to remain obliquely outstanding from the panel, by the resiliency of the material, provided it gets the opportunity to do this. It will have such an opportunity if, for example, it is formed between two incisions reaching inwardly to near the folding line, though hereby the middle portion will get the character of a pivotal flap that will not be particularly stable. If, however, this middle flap is designed as an outwardly arched, relatively broad tongue portion, the outer or central end portion may, after the folding, remain pronounced projecting and yet be in a stabilizing connection with the two fixed side areas. This stabilization is effective with respect to both pressing and pulling forces on the projecting edge of the tongue flap, as this flap will be shaped as a section of a cone surface that is secured along the sides, whereby it will effectively resist being pressed flat, while the outer, projecting edge portion appears on an arched surface, from which it cannot possibly be bent further out.

Thus, the outbulging locking portion or locking edge will constitute a three dimensional stabilized locking element which may maintain a good locking effect by many consecutive openings and closings of the box, when suitably placed thereon.

Projecting locking flaps, when used, are most commonly provided adjacent the sides of the pivot lid, but in connection with the invention it will normally be to prefer that the locking engagement is arranged at or behind the middle of the front side of the lid, because this side will normally be broad enough to accommodate the said tongue portion with a width sufficient for the tongue end to be pronounced projecting and and yet stabilized as described. The tongue end may then cooperate with an edge portion of a slot shaped hole in the front panel of the box near the mouthing thereof. This also implies that the same edge portion will occur on a broad panel, whereby it can reasonably easily yield inwardly for allowing the passage of the projecting locking edge when the lid is opened and closed, such that the desired lasting snap lock action can be ascertained.

Figure 2:
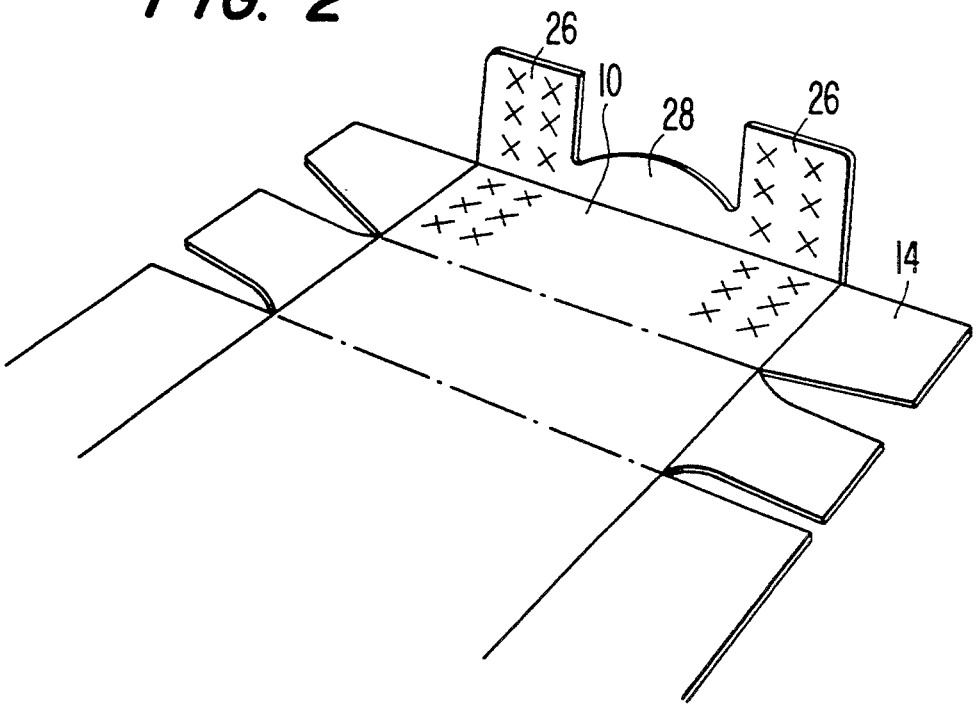
Figure 3:
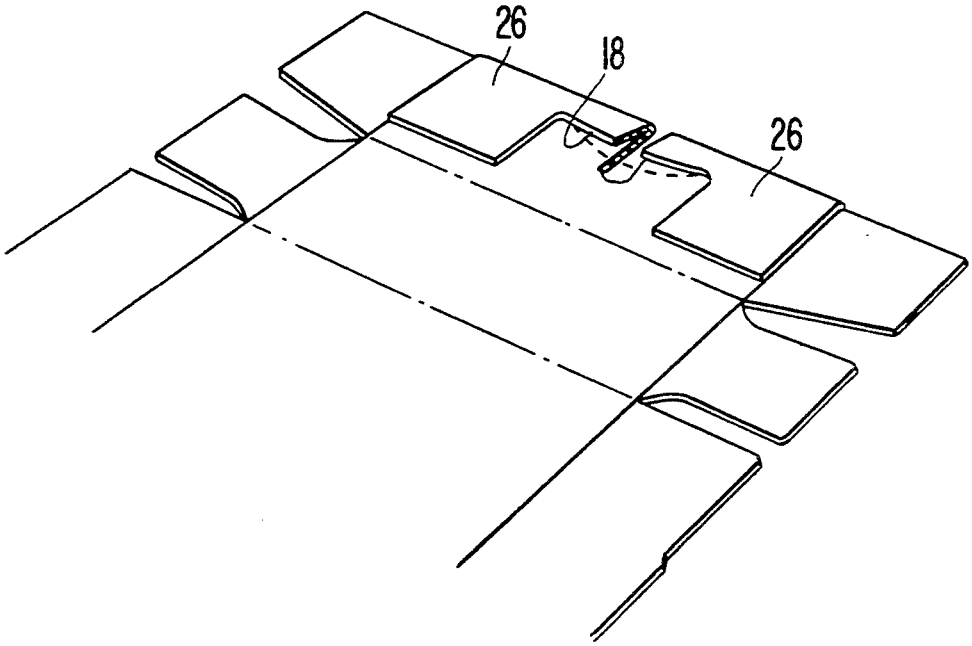
Figure 4:
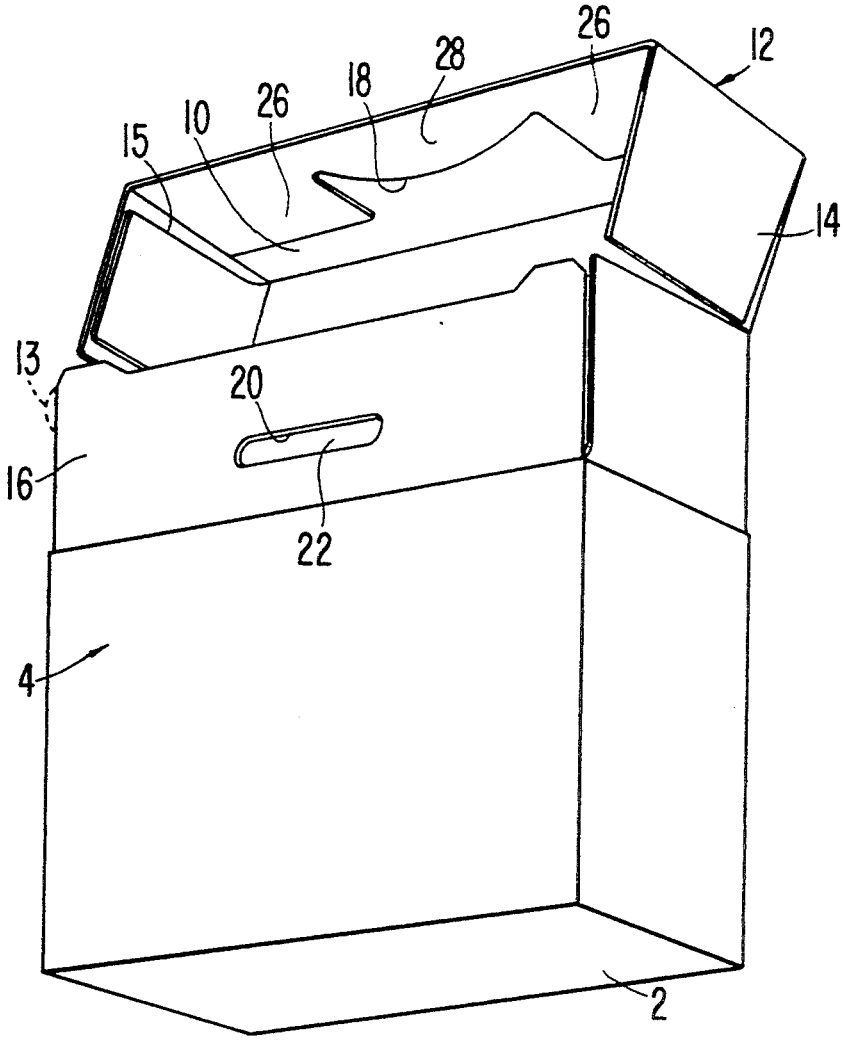
Figure 5:
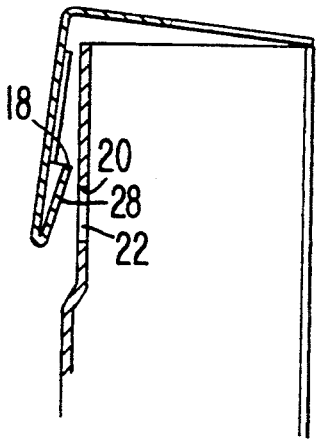
Figure 6:
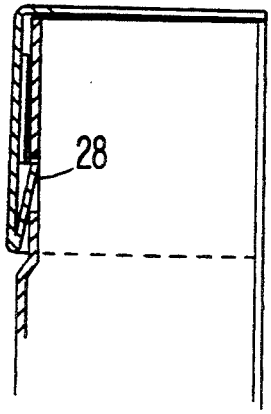

In the following the invention is described in more detail with reference to the drawing, in which:

FIG. 1 is a plan view of a carton blank for a box according to the invention, FIGS. 2 and 3 are perspective views illustrating the provision of a locking portion on the blank, FIG. 4 is a perspective view of an erected box in its open condition, and FIGS. 5 and 6 are lateral sectional views of the box in almost closed and fully closed condition, respectively.

The blank shown in FIG. 1, erectable to a pastille box as shown in FIG. 4, will here be described in terms referring to the box orientation according to FIG. 4, i.e. a standing box having an upper pivot lid. The blank and the box have a bottom panel 2, a front side panel 4 and a rear side panel 6, which is extended upwardly in a lid top panel 8 and a lid front panel 10. Furthermore, the blank includes various side panels and corner flaps, which will not here need any more detailed description, as the basic design of the box is conventional. The box has a pivot lid 12, which is hinged to the rear side panel 6 and is provided with side panels 14, which, when the lid is closed, is swung down to a position outside the upper ends of the side panels of the box, while correspondingly the lid front side 10 will cover an upper portion 16 of the front side panel 4. This portion 16 is pressed slightly rearwardly relative to the underlying part of the panel 4, such that the lid front side 10, which is a double carton layer, will project only moderately in front of the front panel surface of the box.

For snap locking of the lid in the closed position thereof there is provided, on the interior side of the lid front panel 10, a projecting locking edge 18, FIG. 4, cooperating with the top edge 20 of an oblong hole 22 in the upper front panel portion 16. The shaping of the locking edge 18 will now be described with reference to FIGS. 1–3:

On the box blank the front panel 10 of the lid is extended upwardly into a free flap 24 consisting of two side portions 26 and and a shorter projecting intermediate portion 28, the latter terminating in the already mentioned edge 18, which forms a convex arc of a circle with rounded transitions 30 to the interior side edges of the side portions 26. In a practical example, where the height of the lid front panel 10 is 15 mm, the bottom of the transitions 30 may be located 3 mm from the folding line, f, between the portions 10 and 24, while the top height of the arched edge 18 above the same line is 5 mm and the width of the arched edge 18 is 20 mm.

The blank is prepared for the erection of the box by folding the flap 24 inwardly and downwardly over the panel 10 and, as shown in FIG. 2, arranging for the side portions 26 to be sealed to the panel 10 by this folding, while the middle portion 28 is not sealed. This portion, therefore, will seek to fold itself back by virtue of the resiliency of or in the folding, i.e. the edge 18 will lift itself somewhat—or rather not be pressed entirely down at the middle of the portion 28. In FIG. 3 it is shown by a dotted line how the edge 18 would be located by a total folding down against the panel 10, and it will be noted that the edge 18 is projecting therefrom and shaped so as to be farthest projecting by its middle portion and to extend double-curved therefrom both outwardly towards the folding line f and inwardly towards the transition areas 30. Thus, the flap portion 28 will occur as a section of a conical surface, and since the side portions 26 are fixed to the panel 10 the double arched edge 18 will thus be strongly stabilized both against being broken outwardly and against being permanently pressed inwardly.

As shown in FIG. 5 the middle area of the projecting edge 18 is provided at a place just next to the top edge 20 of the slot hole 22 in the upper front panel 16 of the box, and when the lid is closed there will be established at this place a snap locking engagement between these edges, as illustrated in FIG. 6.

When the front side of the lid is pushed upwardly this engagement will be released by the front panel portion 16 yielding resiliently inwardly, just as it will yield correspondingly for reestablishing the locking engagement by a subsequent closing of the lid.

Seen from the outside this locking system will reveal itself only by the occurance of the slot hole 22 in the panel portion 16, but this will be without any kind of real disadvantage. Moreover, it will not be necessary to make use of an open hole, as a non-perforated carton layer could be arranged at the rear side of the panel portion 16, whereby the locking edge 18 could still cooperate with with the edge 20 of the hole 22 in the foremost panel layer.

The locking engagement may also be released by a rather pronounced pressing in of the middle area of the front panel portion of the box, whereby the lid will then pivot somewhat upwardly by virtue of the resiliency in the folding between the rear box panel and the top panel of the lid.

It should be mentioned that a remarkably strong locking engagement will be achievable between two mutually inverted bulging formations 28.

The use of the disclosed locking engagement will not exclude an additional use of other kinds of engagements, for example between projecting ear flaps 13 on the side edges of the front panel portion 16, see FIG. 4, and an edge portion 15 of one of the side flaps of the lid.

We claim:

1. A carton box of the pivot lid type, in which an open end of the box is covered by a lid member, which is pivotal outwardly and upwardly about a hinge line at a rear side of the box, while at its remaining three sides it has depending skirt portions, which in a closed condition of the lid are projecting inwardly or downwardly so as to overlap a mouthing area of the box in an overlapping area, whereas at at least one place in the overlapping area there is provided a snap locking connection between the box and the lid by means of a locking nose which is arranged projecting from an inner side of a front skirt portion of the lid and is engageable with a locking edge on an opposed part of a front panel of the box, said locking nose being of the type formed by folding-over of an edge flap, outer side portions of which are fixed face-to-face to an underlying skirt portion while an intermediate locking nose portion is left slightly bulging out from said underlying skirt portion, characterized in that the locking nose portion is shaped with a convex, arched, free outer edge enabling the locking nose portion to engage into at least a depression defining the locking edge and having a width dimension of the same magnitude as that of the locking nose portion itself.

2. A box according to claim 1, in which the outer side portions project longer outwardly than the locking nose portion, and in which the occurring corners between outer edges of the locking nose portion and inner side edges of the outer side portions are softly curved.

3. A carton box of the pivot lid type, in which an open end of the box is covered by a lid member, which is pivotal outwardly and upwardly about a hinge line at a rear side of the box, while at its remaining three sides it has depending skirt portions, which in a closed condition of the lid are projecting inwardly or downwardly so as to overlap a mouthing area of the box in an overlapping area, whereas at at least one place in the overlapping area there is provided a snap locking connection between the box and the lid by means of a locking nose which is arranged projecting from an inner side of a front skirt portion of the lid and is engageable with a locking edge on an opposed part of a front panel of the box, said locking nose being of the type formed by folding-over of an edge flap, outer side portions of which are fixed face-to-face to an underlying skirt portion while an intermediate locking nose portion is left slightly bulging out from said underlying skirt portion, in which the width dimension of the locking nose portion is small enough to make the outbulging curved/-conical all over the width, sufficient to stabilize the nose portion in a rigid three-dimensional shape.

4. A box according to claim 1, in which the locking edge as formed by a slot in the front panel of the box has a length that is less than half the width of the front panel.

5. A box according to claim 1, in which the locking nose cooperates with a transverse narrow slot in the front panel of the box, the width of this slot being noticeably smaller than the length of a middle portion of the locking nose as projecting obliquely from its base edge.

6. A box according to claim 1, in which the locking edge is defined by an open slot.

7. A box according to claim 1, in which the opposed part of the front panel comprises two layers, the locking edge comprising a slot through a first of the two layers, the slot having a solid backing comprised of the second of the two layers.

* * * * *